United States Patent [19]

Norris

[11] 4,385,718

[45] May 31, 1983

[54] STRIP ADVANCING MECHANISM

[75] Inventor: Dallas G. Norris, Indianapolis, Ind.

[73] Assignee: Western Electric Company, Inc., New York, N.Y.

[21] Appl. No.: 310,251

[22] Filed: Oct. 9, 1981

[51] Int. Cl.[3] ..... B65H 17/40

[52] U.S. Cl. ..... 226/68; 226/62; 226/162

[58] Field of Search ..... 226/57, 52, 59, 62, 226/67, 68, 70, 71, 72, 158, 159, 162, 163, 164

[56] References Cited

U.S. PATENT DOCUMENTS

| | | | |
|---|---|---|---|
| 1,403,106 | 1/1922 | Pittman | 226/67 |
| 1,860,144 | 5/1932 | Gaisman et al. | 226/67 |
| 2,001,520 | 5/1935 | Carlson | 226/67 |
| 2,768,826 | 10/1956 | Gaite | 226/62 |
| 2,866,638 | 12/1958 | Mannisto | 226/67 |

*Primary Examiner*—Stanley N. Gilreath
*Attorney, Agent, or Firm*—J. J. Jordan

[57] ABSTRACT

Apparatus (20) for imparting stepwise movement to a strip (10) having pilot holes (12) comprising, a frame (27), a carriage (26) mounted by said frame to be longitudinally movable in relation thereto, a pin (22) coupled with said carriage movable therewith and laterally movable in relation to said path between positions at which pin is adapted to enter into and to be retracted from a pilot hole in said strip. A link (30) is adapted to undergo alternate forward and reverse strokes and is coupled to said carriage by a lost motion coupling (46, 57, 56, 57) so that, during a first interval of each such stroke, the carriage and link are uncoupled with the carriage remaining stationary and, during a second interval of each of such strokes, the carriage and link are coupled to move together. Camming surfaces (31, 32) are responsive to change in the relative positioning of the carriage and link to move the pin to positions the pin enters into a pilot hole and is retracted therefrom the overall movement of the pin producing the stepwise movement.

5 Claims, 4 Drawing Figures

STRIP ADVANCING MECHANISM

TECHNICAL FIELD

This invention relates generally to mechanisms for imparting stepwise movement to an object and, more particularly, to mechanisms of such kind to impart such movement to a strip having pilot holes therein.

BACKGROUND OF THE INVENTION

In the manufacture from a strip of stock material of parts such as electrical terminals, flat spring elements, and the like, it is often necessary that there be imparted to the strip an intermittent movement by which it is advanced step by step into a station at which one of such parts is punched out of or otherwise formed from the strip during the pause intervening each step movement. Various mechanisms for providing such stepwise movement to a strip have been heretofore proposed as follows.

U.S. Pat. No. 1,860,144 issued Mar. 24, 1932 to H. J. Gaisman et al. discloses a mechanism for advancing stepwise a strip having perforations thereon and from which razor blade blanks are formed. The mechanism comprises a reciprocably movable member disposed adjacent to the path of the strip, a finger pivotally mounted on the front end of such member to project toward and register with the perforations in the strip, and a spring urging the finger to contact the strip and enter the perforations. The mentioned member undergoes in alternation forward and reverse strokes parallel to the strip path. At the start of the forward stroke, the finger is seated in a strip perforation so as to cause such stroke to propel the strip one step forward against a frictional retarding force exerted on the strip by a brake. At the beginning of the return stroke, the finger is caused by the holding of the strip by such force to emerge from such perforation against the bias exerted on the finger by such spring, and to then slide over the strip during the return stroke until, at the end of it, the finger becomes seated in the next perforation.

U.S. Pat. No. 2,768,826 issued Oct. 30, 1956 to H. D. Gaite discloses a mechanism for advancing, say, perforated telegraph tape, stepwise, the device comprises a drive member disposed below the tape path and having at its tip a series of pins adapted to be entered into and retracted from pilot perforations in the tape. A reversibly movable link is connected to such member to exert thereon a force inclined to the vertical so as to exert on the member a vertical force component which is alternately up and down and a horizontal force component which is alternately forward and reverse. Various stop elements cooperate with the drive member to constrain its movement in response to such inclined force to an up-forward-down-reverse rectangular movement transmitted to the pins to cause them to move the tape stepwise by, in sequence, entering the pilot perforations of the tape, advancing it a step, retracting from the perforations, and returning to start position.

U.S. Pat. No. 1,403,106 issued Jan. 10, 1922 to R. W. Pittman discloses a mechanism for advancing motion picture film stepwise. The mechanism comprises a carrier operable by a crank to longitudinally reciprocate forward and back parallel to the path of the film, a pair of arms slidably mounted by the carrier to be transversely movable towards and away from the film, and means operated by the crank to give the arms a transverse reciprocating motion causing them to enter into and retract from the feed perforations in the film. That transverse motion is coordinated with the longitudinal reciprocating movement of the the carrier such that the pins undergo in relation to the film an in-forward-out-reverse movement producing stepwise advancement of the film.

SUMMARY OF THE INVENTION

In contrast to the mechanisms described above, apparatus according to the invention comprises a frame definitive of such path and a carriage mounted by said frame to be longitudinally movable in relation thereto. A pin is coupled with said carriage to be longitudinally movable therewith and laterally movable in relation to said path between positions at which pin is adapted to enter into and to be retracted from a pilot hole in said strip.

Also included in the apparatus is a carriage positioning means for determining the longitudinal position of said carriage in relation to said frame, the positioning means including carriage drive means adapted to undergo alternate forward and reverse strokes and coupled to said carriage by a lost motion coupling so that, during a first interval of each such stroke, such carriage and drive means are uncoupled with said carriage remaining stationary and, during a second interval of each of such strokes, such carriage and drive means are coupled to move together. Such carriage means is supplemented by pin positioning means responsive to change in the relative positioning of said carriage and drive means during the second interval of, respectively, the forward stroke and the reverse stroke of said drive means to move said pin to said positions at which, respectively, said pin is adapted to enter into said pilot hole and to be retracted therefrom. The overall movement of the pin is an in-forward-out-reverse movement by which the pin causes the strip to be advanced step by step.

BREIF DESCRIPTION OF THE DRAWINGS

For a better understanding of the invention, reference is made to the following description of a representative embodiment thereof and to the accompanying drawings wherein.

DETAILED DESCRIPTION

Figure 1:
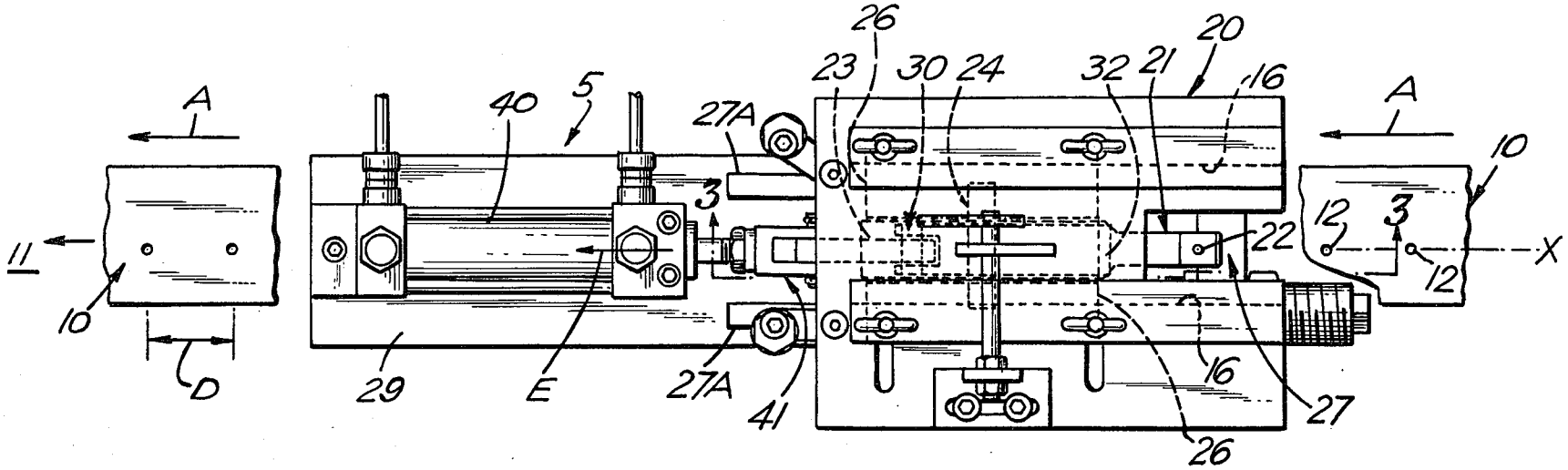
FIG. 1 is a plan view of equipment including mechanism for advancing a strip step-by-step.

Referring first to FIG. 1, a continuous length of thin rectangular metal strip stock 10 is processed by the equipment 5 shown in that FIGURE. In the course of such processing the strip 10 is intermittently advanced (arrows A) from right to left in the drawings to a work location 11 (not shown), such as punching, forming or welding stations off the page to the left in the drawings. As is customary, the stock is formed with a succession of pilot holes 12 at regularly spaced intervals along the length thereof, for guiding the stock and precisely locating it with respect to the work stations.

Figure 3:
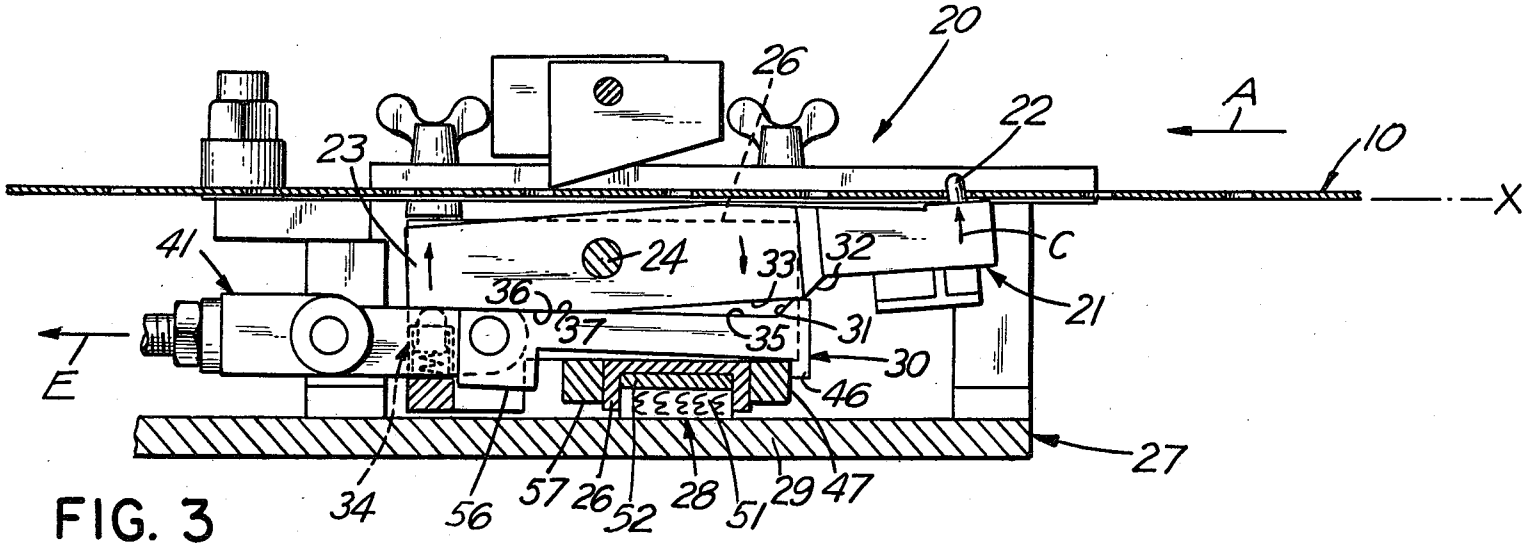
FIG. 3 is a front elevation in cross section, taken as indicated by the arrows 3—3 in FIG. 1, of principal parts of said mechanism at the beginning of a forward step movement of such strip.
Figure 4:
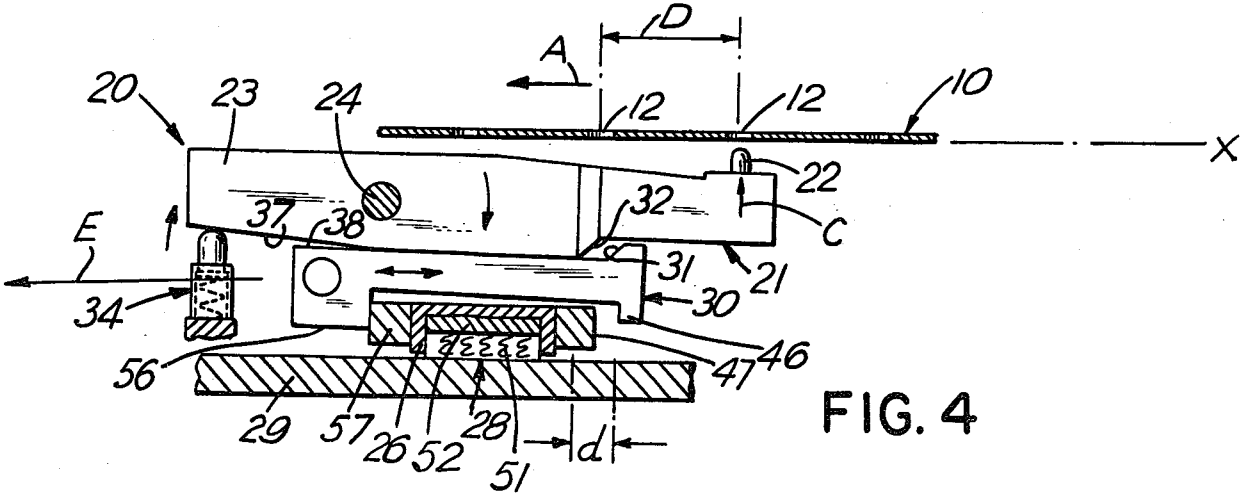
FIG. 4 is a front elevation in cross section, taken similarly to FIG. 3, except that some details have been omitted, and the mentioned mechanism is protrayed as it is at the end of a return stroke.

Equipment 5 includes automatic feeding apparatus 20 having a stationary combination of parts or frame 27 mounted by the equipment and definitive of a longitudinal path through the apparatus for movement of strip 10, the edges of such path being indicated by dotted lines 16. Apparatus 20 operates to intermittently advance such strip stock 10 forward a predetermined distance "D", equal to the spacing between two consecutive holes 12—12, along a longitudinal horizontal axis X running through the holes, while maintaining the horizontal position and alignment of the pilot holes. Referring particularly to FIGS. 3–4, apparatus 20 includes a feed finger 21 arranged generally horizontally in the device and including a vertically projecting pilot pin 22 formed along a flat upper surface thereof, finger 21 being the front part of a horizontal arm 23. In the rest position of the device (FIG. 4), the pin 22 is positioned vertically just below and in alignment with one of the pilot holes 12 in the stock. When the apparatus is actuated, the finger 21 is first pivoted a limited distance counterclockwise (arrow C in FIG. 4) so that the pin 22 moves laterally upward a limited distance from the FIG. 4 position to the engaged position illustrated in FIG. 3, in which the pin 22 engages in the pilot hole 12 and the finger 21 then supports the stock for horizontal movement to the left in FIGS. 3–4. The pin 22 is formed with a rounded upper end to facilitate entry into the hole 12, and precise alignment of the stock 10 with the feed device.

Figure 2:
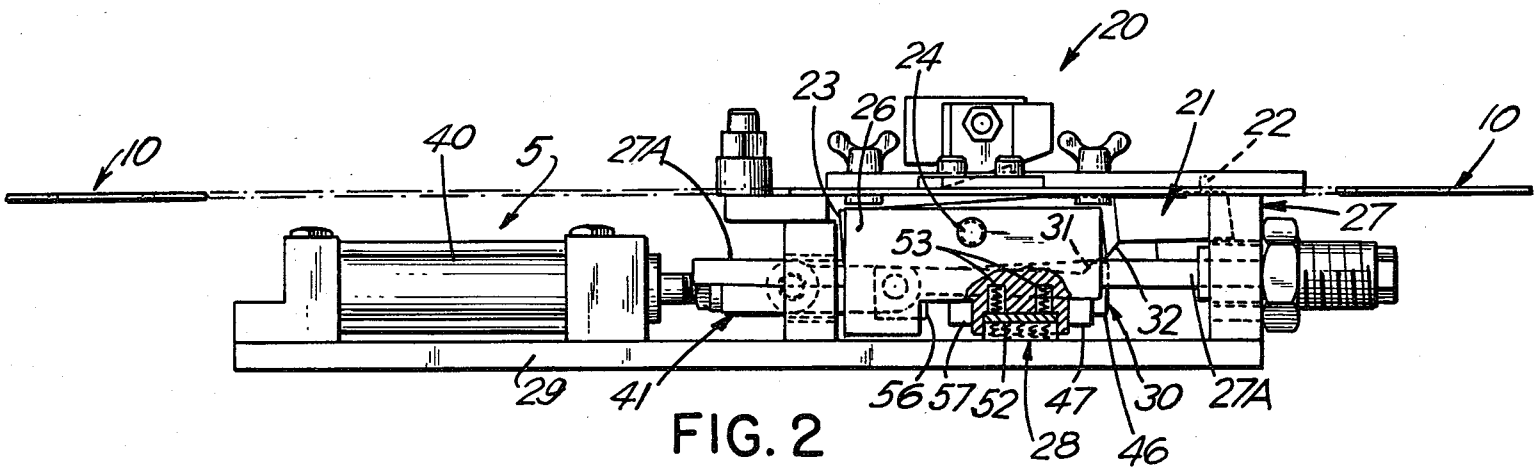
FIG. 2 is a front elevation of the equipment shown in FIG. 1 with part of it broken away to show in cross section a portion of such mechanism.

To mount the finger 21 for such movement, the left end of the finger joins with another part of horizontal arm 23 that extends to the left of the finger 21 and is rotatably mounted on a transverse pivot shaft 24 that permits pivoting of the arm 23. The shaft 24 is mounted on a carriage 26 (FIG. 2) that is reciprocably mounted by frame 27 for sliding movement of the carriage to the left and right in FIGS. 1–4 along horizontal guide rods 27-A forming part of the frame. At the start of a feeding operation, the carriage 26 is frictionally held against horizontal movement by a releasable brake mechanism 28 which is part of a carriage positioning means, and which fits between portions of a flat undersurface of the carriage 26 and a fixed flat horizontal baseplate 29 of the frame 27.

Apparatus includes as another part of such carriage positioning means a carriage drive means in the form of a reciprocable carriage driving link 30 that is slidably mounted on the carriage 26 for horizontal movement to the left and right in FIGS. 1–4. The link 30 is mounted laterally beneath the feed finger 21 as illustrated in FIGS. 3–4 and, in the rest position of the device, the link 30 is located in a first position shifted to the right with respect to the feed finger 21 as illustrated in FIG. 4, so that a tapered camming surface 31 adjacent to the right or free end of the link 30 extends to the right beyond and is clear of matingly tapered camming surface 32 formed along the undersurface of the arm 23 of the feed finger 21. In the rest position, the feed finger 21 is pivoted clockwise downward to a horizontal downstop position by spring means in the form of a pair of spring-loaded plungers 34 that are positioned on the carriage 26 between a left end portion of the carriage and the left undersurface of the finger arm 23 so that the plungers 34 normally pivot the finger 21 laterally downward to the horizontal rest or starting position in which portions 33 of the flat undersurfaces of the arms 23 engage the flat upper surface 35 of the bar 30 to the left of the cam face 31 as shown in FIG. 4 to thereby stop the arm from being moved beyond that position under the urging of spring plungers 34. Similar stop surface 36 and 37 on, respectively, arm 23 and link 30 engage when arm 30 is moved up to preclude its upward movement past the position shown in FIG. 3. Elements 31–37 are all parts of a pin positioning means.

At the start of each feed operation, actuator means in the form of an air cylinder 40 is operated to advance the link 30 a preset distance to the left, arrow E in FIGS. 3–4, through a coupling linkage 41. During a first interval of such forward stroke of the link 30 (distance "d" in FIG. 4), the carriage 26 and feed finger 21 remain fixed horizontally with respect to the frame 27, due to the action of the brake 28, during which interval the camming face 31 of the link 30 slides to the left and engages the cam face 32 of the finger 21, which pivots the finger 21 upward (arrow C) so that the pin engages in the pilot hole 12 as previously described and as illustrated in FIG. 3.

Immediately after such engagement of the finger 21 with the stock 10, a depending finger portion 46 at the right end of the link 30 engages a transverse rail 47 mounted along the right side of the carriage 26 as illustrated in FIG. 3. This operates to couple the link 30 to the carriage 26 so that during a second interval of the forward stroke of the link, continued advancement of the bar 30 to the left (arrow E) pulls the carriage 26 to the left with the bar 30, overriding the friction of the brake 28 by the force applied to the carriage by the link. Since the feed finger 21 is mounted on the carriage 26 for horizontal movement therewith, continued movement of the link to the left causes the pilot pin 22 to advance the strip stock to the left any desired distance (arrow A), set by the length of the stroke of the air cylinder 40, the total stroke being essentially D+d, where d also represents the lost motion movement of the link 30 prior to the point where the finger 46 engages the carriage rail 47.

The brake 28 includes a rectangular fabric pad 51 mounted to a flat metal backing plate 52 and mounted by biasing springs 53 (FIG. 2) in a pocket formed in the undersurface of the carriage 26, so that the undersurface of the pad 51 frictionally engages the upper surface of the baseplate 29. With this arrangement, the mechanical friction between the pad 51 and the baseplate 29 is sufficient to temporarily hold the carriage 26 against horizontal movement with the link 30, until the finger member 46 of the bar engages the carriage rail 47, after which the pad 51 slides along the surface of the baseplate 29 as the carriage is pulled to the left by the bar 30 on the forward stroke.

On the return stroke of the cylinder 40, the carriage 26 is first held stationary by the brake 28 as the link 30 starts the first interval of its return stroke during which it travels to the right with respect to the carriage and feed finger 21. During such first interval of the return stroke, the link 30 shifts the short distance d to the right with respect to the finger 21, until the camming surface 31 rides out from under the cam surfaces 32 of the finger 21, and the finger is then pivoted back to the initial horizontal position (FIG. 4) by the spring plungers 34 so that the pilot pin 22 is retracted from the pilot hole 12 of the stock and the feed finger 21 is thereafter clear of the stock during the remainder or second interval of the return stroke.

Approximately as this happens, a second depending finger portion 56 adjacent to the left side of the link 30 engages a transverse rail 57 along the left side of the carriage 26, as illustrated in FIG. 4, overriding the brake 28, so that the link 30 thereafter pushes the carriage 26 and feed finger back to the initial, rest position shown in FIG. 4 to complete the return stroke of the cylinder 40 and link 30 and to position the apparatus 20 for the next feeding step.

The above described embodiment being only exemplary, additions thereto, omissions therefrom and modifications thereof may be made without departing from the spirit of the invention. Accordingly, the invention is not to be considered as limited save as is consonant with the scope of the following claims.

What is claimed is:

1. Apparatus for imparting stepwise movement in a longitudinal path to a strip having pilot holes passing laterally therethrough comprising, a frame definitive of such path, a carriage mounted by said frame to be longitudinally movable in relation thereto, a pin coupled with said carriage to be longitudinally movable therewith and laterally movable in relation to said path between positions at which pin is adapted to enter into and to be retracted from a pilot hole in said strip, carraige positioning means for longitudinally positioning said carriage in relation to said frame and including carriage drive means adapted to undergo alternate forward and reverse strokes and coupled to said carriage by a lost motion coupling, said positioning means being operable such that, during a first interval of each such stroke, such carriage and drive means are uncoupled while said carriage remains stationary and, during a second interval of each of such strokes, such carriage and drive means are coupled to longitudinally move together, and pin positioning means responsive to change in the longitudinal relative positioning of said carriage and drive means during the first interval of, respectively, the forward stroke and the reverse stroke of said drive means to move said pin to positions at which, respectively, said pin is adapted to enter into said pilot hole and to be retracted therefrom.

2. Apparatus for imparting stepwise movement in a longitudinal path to a strip having pilot holes passing laterally therethrough comprising, a stationary frame definitive of such path, a carriage mounted by said frame to be in laterally spaced relation from said path, said carriage being reciprocably movable longitudinally in relation to said frame, an arm pivotally mounted by said carriage to be longitudinally movable therewith and angularly movable with respect thereto between first and second positions at which said arm is respectively, laterally towards and away from said path, a pin on said arm adapted to be inserted into and retracted from said holes in said strip when said arm is, respectively, in said first and said second position, a brake for frictionally holding said carriage longitudinally stationary in the absence of force applied thereto, a carriage driving link reciprocably movable longitudinally in forward and reverse strokes and coupled to said carriage by a lost motion coupling by which, during first and second intervals of each such stroke, said carriage is, respectively, uncoupled from said link to be held stationary by said brake and coupled with said link to be caused to move therewith by force therefrom overcoming the friction of said brake, actuator means for moving said link to undergo in alternation said forward and reverse strokes, and pin positioning means responsive to changes in the longitudinal relative positioning of said carriage and link occurring in the first interval of each of, respectively, such a forward stroke and the subsequent reverse stroke to displace said arm and pin so as to cause said pin to be adapted to be inserted into and retracted from a pilot hole of said strip during, respectively, such first interval of such forward stroke and such subsequent first interval of said reverse stroke, said carriage movement during the second interval of each of, respectively, such forward and such reverse strokes being adapted to, respectively, cause propulsion by said pin of said strip a step in said path and longitudinally reposition said pin for insertion in the next pilot hole of said strip.

3. Apparatus according to claim 2 in which said arm is laterally disposed between said path and said link so that a lateral side of each of said link and arm faces toward a lateral side of the other, and in which said pin positioning means comprises camming surfaces formed on such lateral sides of said link and arm and adapted, in response to change occurring in the longitudinal relative positioning of such carriage and link during said first interval of such forward stroke to slidably engage with each other to thereby cam said arm to said first position, said camming surfaces thereafter maintaining said arm so positioned during the second interval of said forward stroke.

4. Apparatus according to claim 3 in which said pin positioning means further comprises spring means on said carriage and coupled to said arm to resiliently bias said arm towards said second position, said spring means being responsive to change occurring in the relative longitudinal positioning of said carriage and link during the first interval of the return stroke of said link to drive said arm to said second position, and said spring means thereafter maintaining said arm so positioned during the second interval of such reverse stroke.

5. Apparatus according to claim 4 in which said pin positioning means further comprises stop surfaces formed on, respectively, said respective lateral sides of said arm and link and adapted by engaging with each other to preclude movement of said arm from said first position to laterally beyond said second position and from said second position to laterally beyond said first position.

* * * * *